US005297544A

United States Patent [19]

May et al.

[11] Patent Number: 5,297,544

[45] Date of Patent: Mar. 29, 1994

[54] RESPIRATOR WITH INNER HALF MASK AND POLLUTANT INDICATOR

[75] Inventors: Wolfgang May, Reinfeld; Wolfgang Bäther; Carl-Ernst van der Smissen, both of Luübeck; Gerhold Mühmel, Hamberge, all of Fed. Rep. of Germany

[73] Assignee: Dragerwerk AG, Lubeck, Fed. Rep. of Germany

[21] Appl. No.: 947,769

[22] Filed: Sep. 18, 1992

[30] Foreign Application Priority Data

Oct. 1, 1991 [DE] Fed. Rep. of Germany ..... 4132680

[51] Int. Cl.[5] ..... A62B 9/00; A62B 27/00

[52] U.S. Cl. ..... 128/202.22; 128/206.21; 422/91

[58] Field of Search ..... 128/202.22, 205.28, 128/206.21, 206.23, 207.11, 206.12, 206.14, 206.15; 340/632; 422/86, 87, 91; 204/426, 431; 338/34

[56] References Cited

U.S. PATENT DOCUMENTS

| | | | |
|---|---|---|---|
| 3,395,701 | 8/1968 | Bartlett | 128/202.22 X |
| 4,146,887 | 3/1979 | Magnante | 340/632 |
| 4,263,588 | 4/1981 | Gautier | 340/632 |
| 4,326,514 | 4/1982 | Eian | 128/202.22 |
| 4,428,907 | 1/1984 | Heijenga | 422/61 |
| 4,654,624 | 3/1987 | Hagan | 338/34 |
| 4,662,996 | 5/1987 | Venkatasetty | 204/431 X |
| 4,873,970 | 10/1989 | Freidank | 128/202.22 |
| 4,886,056 | 12/1989 | Simpson | 128/201.25 |
| 5,018,518 | 5/1991 | Hübner | 128/202.22 |
| 5,039,490 | 8/1991 | Marsoner | 422/91 X |
| 5,057,436 | 10/1991 | Ball | 338/34 X |
| 5,059,394 | 10/1991 | Phillips | 422/91 X |

FOREIGN PATENT DOCUMENTS

| | | | |
|---|---|---|---|
| 643291 | 6/1962 | Canada | 128/202.22 |

*Primary Examiner*—Edgar S. Burr
*Assistant Examiner*—Eric P. Raciti
*Attorney, Agent, or Firm*—McGlew and Tuttle

[57] ABSTRACT

A respirator with an eye space (16), through which the air to be inhaled flows, and with an indicator located on a support for indicating the efficiency of the protective device on the respiration connection, which is to retain the pollutant from the environment. The pollutant indication takes place both in the case of leakages at the sealing zones of the mask or the respiration gas-carrying lines (compressed air respirator) and in the case of insufficient filter effect. To achieve this, the support (10) is arranged on an inner half mask (3) of the respirator, and an access surface, which is exposed to the pollutant and contains the indicator (18, 118), is in flow contact with the air being inhaled, which flows through the passage openings (12, 112) between the eye space (16) of the full mask (1) and the inner half mask space (4).

13 Claims, 2 Drawing Sheets

RESPIRATOR WITH INNER HALF MASK AND POLLUTANT INDICATOR

FIELD OF THE INVENTION

The present invention pertains to a respirator with an eye space through which inhaled air flows more particularly to such a respirator with an indicator located on a support for indicating the efficiency of a protective device which retains the pollutant from the environment and is located on the respiration connection.

BACKGROUND OF THE INVENTION

The above mentioned type of respirators are used for supplying respiration gas for persons who have to work or stay in an atmosphere that is hazardous for breathing. The air to be inhaled is purified or freed from the pollutant via a filter, or respiration gas is supplied into the respirator from a bottle-type reservoir via a flexible tube. In the case of respirators with a filter, indicators are arranged on or in the filter, and they either indicate the depletion of the filter material or the breakthrough of pollutants, so that the user of the mask will be warned or is able to replace the filter in time. Even though monitoring of filter devices is eliminated in compressed-air respirators, it is just as important to monitor the full facepiece mask for sealed fitting on the face part of the mask user in order to recognize whether leaks, which make it possible for pollutant-loaded ambient air to enter the air to be inhaled, occur at the sealing edge. In this sense, the term "respiration connection" can be considered to denote both the filter connection and the tube connection for a compressed air-operated respirator or for the full facepiece mask itself.

In a prior-art full facepiece mask according to DE-PS 962,313, a colorimetric indicator is provided in the interior space of the mask, and it indicates the passage of harmful components from the environment into the interior space of the mask by a detection reagent arranged on a support changing its color in the presence of the pollutant being monitored. However, this prior-art mask has the disadvantage that it is dependent on the site of application of the indicator, insofar as passage due to leakage or depletion of the filter is indicated, depending on whether the air to be inhaled also flows past the indicator. The respiration air is routed, especially in respirators with inner half mask, such that passage openings with corresponding check valves, through which the air to be inhaled flows, are provided between the outer space of the mask and the inner space of the mask. In an air stream thus directed, the prior-art indicator is usually located in the flow shadow, and it permits only inaccurate indication of pollutant passing through at best.

SUMMARY AND OBJECTS OF THE INVENTION

A primary object of the present invention is to improve a respirator of the class described such that pollutant indication will take place spontaneously both in the case of leakages at the sealing zones of the mask or on the respiration gas-carrying lines in the case of compressed air respirators and in the case of insufficient filter effect.

The task is accomplished by the support being arranged on an inner half mask of the respirator and by an access surface containing the indicator being located in the area of the passage openings connecting the eye space with the inner half mask space in guided flow contact with the air to be inhaled.

The present invention offers the advantage that all the air to be inhaled must be forcibly passed by the indicator, regardless of the type of respiration connection. Such a pollutant indication simultaneously registers the retention effect of the filter and the sealing effect of the edge of the mask, as well as the tightness of the mask with its built-in parts.

To improve the handling of the indicator for, e.g., cleaning or service operation, it is advantageous to provide a removable insert, which can be removed and reinstalled, if desired.

In a simple embodiment, the indicator consists of a detachable disc, which is applied by adhesion to the inner surface of the half mask body. It can easily be removed and replaced with another one if different pollutants are to be detected.

To further increase the versatility of the use of an indicator, it is favorable to design it as a chip-like support. This is provided with a plurality of indicating ranges, which are able to detect either the same pollutant at different levels of sensitivity or different pollutants on one indicator. The term "chip-like" shall mean that, similarly to the semiconductor industry, where a chip accommodates different types of electronic assembly units, the chip-like support in this case accommodates different detection systems in miniaturized form. A large number of possibilities of detection in a very small space and on a single support are thus offered to the user. The different indicating ranges are provided with a colorimetric indicator, which indicating ranges have openings, on the one hand, through which the pollutant is able to reach the indicator, and, on the other hand, the ranges are accessible to optical evaluation. This is defined, in the simplest case, as the observation of the degree of change in color by the user, which is able to determine a measure for the amount of pollutant collected or its concentration on the basis of reference standards. For automatic evaluation, it is desirable to have the indicating ranges scanned by an optical evaluation unit.

A suitable form of the indicating ranges can be considered to be indicating ranges which are designed as channels, wherein the channel openings can be considered to be access surfaces for the pollutant to be detected. At least one of the channel walls is designed as an optically transparent cover. Thus, a plurality of colorimetric detection channels are obtained, which are closed on all sides, on the one hand, but have, on the other hand, an entry opening at their inlet or additionally at their channel outlet, wherein the pollutant is able to flow through the entry opening either by diffusion or as a forced flow, sucked in by a delivery means, and the entry opening is able to indicate the pollutant present by a longitudinal change in the color of the indicator. The optically transparent channel wall permits either visual observation of this change in color or evaluation by an optical evaluation unit.

Another advantageous embodiment of the chip-like support can be considered to be one in which the different indicating ranges span over the support in a network-like pattern. They form, so to speak, a two-dimensional matrix, in which every individual range may represent a different sensitivity of detection for the same pollutant, or one or more indication ranges may also indicate different pollutants. At least some of the individual ranges are openly exposed to the pollutant, or, if preselection is to take place in the sense that from a plurality of pollutants, only the pollutant that is actually also detectable by a given indicating range shall gain access to the detection range in question, this range is sealed with a cover that is permeable to the given pollutant and is optically transparent.

A suitable optical evaluation unit contains only a few components, such as a light source and a detector, wherein the light source projects radiation of an appropriate wavelength onto the indicating range, and this [radiation] is received by the detector either by transmission or reflection. The light intensity measured in transmission or reflection is a measure of the amount or concentration of pollutant received by the indicator.

It is advantageous to arrange the evaluation unit in the immediate vicinity of the support in order to continuously monitor the indicator area. Thus, in the case of progression of the change in color beyond a predeterminable limit value, an alarm device is activated, which informs the user of the respirator in time that either a breakthrough of the pollutant through the respiration filter or leakage at the sealing edge of the mask body has taken place.

To simplify handling, the evaluation unit and the support are accommodated in a common, removable insert, wherein this insert also has the passage openings, and accommodates the support in a position that is suitable for evaluation and in which it is exposed to the gas to be inhaled. Thus, the support and the evaluation unit form a common insert, which can easily be replaced for maintenance or cleaning purposes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
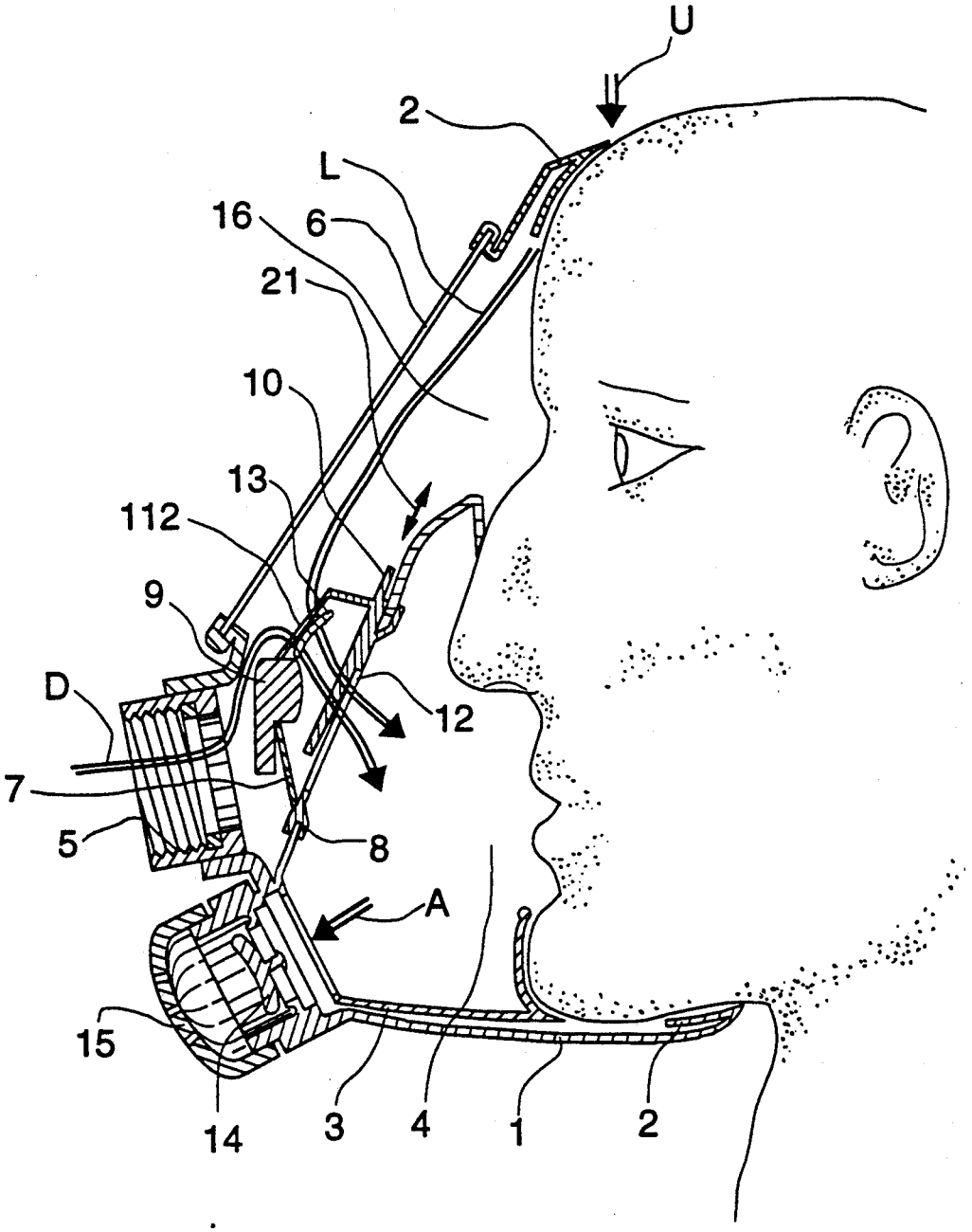
FIG. 1 is a sectional representation of a respirator with a pollutant indicator.
Figure 5:
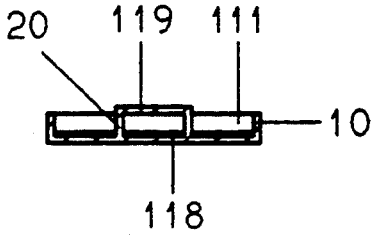
FIG. 5 is a section through the chip-like support according to FIG. 4.
Figure 6:
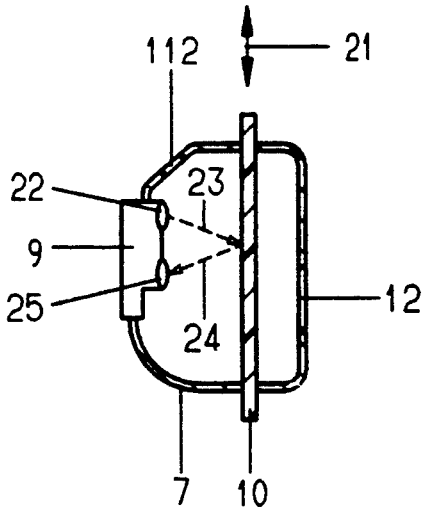
FIG. 6 is a section through the evaluation unit and the support as a removable insert.

In FIG. 1, a full facepiece mask 1 with its sealing edge 2 is in contact with the face of a mask user, and the full mask additionally has an inner half mask 3, which is placed, with its inner half mask space 4, around the nose and mouth area of the mask user. The full mask 1 has a threaded connection 5 for a respiration filter, not shown, which is, however, also able to accommodate the tube connection for the compressed air used as the respiration air in the case of a compressed air respirator. An eye-protective lens 6 permits visual contact with the environment. The inner half mask 3 carries a removable insert 7, which is buttoned, at its edge 8, into a corresponding recess of the inner half mask 3. An evaluation unit 9, which is positioned in the immediate vicinity of and opposite a chip-like support 10 for the colorimetric indicating ranges 11, 111 indicating the pollutant (FIG. 3 and FIG. 5), extends into the insert 7. As shown in FIGS. 1 and 6, the insert 7 is preferably cup-shaped. The support 10 is preferably provided as a detachable disk. The insert 7 has passage openings 12, 112 for the gas to be inhaled, which flows from the filter connection 5 via an inhalation valve 13 into the inner half mask space 4. An exhalation valve 14 with a valve housing 15 permits exhalation along the exhalation arrow A into the environment. Should the inhalation filter be depleted, so that the pollutant passes through the filter, pollutant would penetrate through the passage openings 112, 12 along the inhalation arrow D into the inner half mask space 4, and the pollutant forcibly flows past the support 10, and causes its color to change. A leakage at the sealing edge 2 would, in the same manner, permit ambient air to enter the eye space 16 of the full mask 1 corresponding to the arrow U, and this ambient air would also forcibly enter via the passage opening 12, 112 past the support 10 and into the inner half mask space 4 along the flow arrow L. In both cases, the pollutants carried lead to a change in the color of the indicating ranges (lengths) on the support 10, which are continuously monitored by the evaluation unit 9 and lead to an optical indication device or a similar warning device when a predeterminable threshold value is exceeded.

Figure 2:
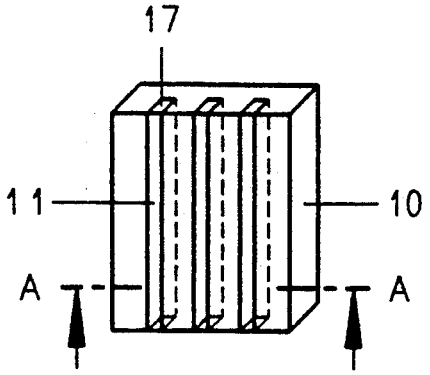
FIG. 2 is a perspective schematic view of a chip-like indicator with channel-like indicating ranges.
Figure 3:
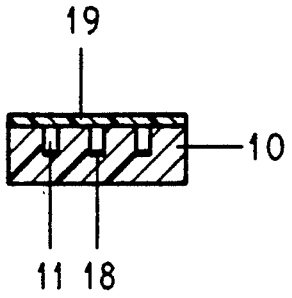
FIG. 3 is a sectional view taken in the direction of line III—III through the support according to FIG. 2.

FIG. 2 shows a chip-like support 10 with its channel-like indicating ranges 11, as can be viewed by, e.g., an observer or a said evaluation unit 9. The channels 11 are exposed, with their channel opening 17, to the pollutant to be detected, which is carried by the air to be inhaled. Via the channel openings 17, the pollutants penetrate by diffusion to the indicator 18 applied to the bottom of the channel 11, and engage there in a color reaction with the indicator 18. The channels 11 are sealed with a permeable, optically transparent membrane 19 (FIG. 3). This seal 19 may be applied to all said channels 11 or only over some of the channels 11.

Figure 4:
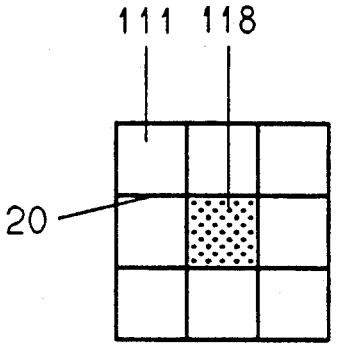
FIG. 4 is a schematic view of a chip-like support with matrix-like distribution of the indicating ranges.

The embodiment according to FIG. 4 shows the chip-like support 10 with a matrix-like arrangement of indicating ranges as indication fields 111. In the form represented, the support 10 has nine such fields 111, each of which is occupied by an indicator 118. In the middle indication field 111, the indicator 118 is indicated by dots. The individual indication fields 111 are separated from one another by partitions 20. Some or all of the indication fields 111 may be sealed with an optically transparent membrane 119 that is permeable to the pollutant to be detected (FIG. 5).

In FIG. 6, the evaluation unit 9 is accommodated in the insert 7, which also contains the support 10 in a suitable holder. The support 10 can be pushed into the holder along the arrow 21 and can be pulled out of it (it can be detached in a similar manner, and the support 10 is fastened by a clamping connection. The evaluation unit 9 has a light source 22 in the form of an LED, which emits light along the radiation arrow 23 onto the support 10, and especially onto one or more of the indicating ranges 11, 111. The reflected light 24 is received and processed by a detector 25. The electronic processing unit as well as the energy needed for the operation of the evaluation unit 9 are accommodated in the same housing for the evaluation unit 9. If the change in color of a said indicating range 11, 111 has increased to beyond a certain threshold value, the evaluation unit sends a warning signal, which is done by, e.g., the radiation source 22 emitting a flashing light, thus signaling to the user of the mask that he should replace the filter or check the mask for proper fitting. The passage openings 12, 112 are located in the insert 7, and the passage opening 112 is provided with the inhalation valve 13, not shown.

While specific embodiments of the invention have been shown and described in detail to illustrate the application of the principles of the invention, it will be understood that the invention may be embodied otherwise without departing from such principles.

What is claimed is:

1. A respirator, comprising: an inner half mask for connection around the nose and mouth of a user; and a full face piece mask having a sealing edge in contact with the face of the user, said full face piece mask cooperating with said inner half mask to define a space between said inner half mask and said full face piece mask, said space being in communication with the eyes of the user; a flow opening in said full face piece mask for flow into said space; a passage opening connecting said space with an interior of said inner half mask; and indicator means located on a support, said indicator means for indicating an amount of pollutant passing into said interior of said inner half mask, said support being positioned on said inner half mask and having an access surface containing said indicator means, said access surface being in flow contact with air being inhaled and said access surface being positioned adjoining said passage opening.

2. A respirator, comprising: an inner half mask for connection around the nose and mouth of a user; and a full face piece mask having a sealing edge in contact with the face of the user, said full face piece mask cooperating with said inner half mask to define a space between said inner half mask and said full face piece mask, said space being in communication with the eyes of the user; a flow opening in said full face piece mask for flow into said space; a passage opening connecting said space with an interior of said inner half mask for flow of gas from said space to said interior of said inner half mask; and indicator means located on a support, said indicator means for indicating an amount of pollutant passing into said interior of said inner half mask, said support being connected to said inner half mask and having an access surface containing said indicator means, said access surface being in flow contact with said flow of gas from said space to said interior of said inner half mask and said access surface being positioned adjoining said passage opening.

3. A respirator, comprising: an inner half mask for connection around the nose and mouth of a user; and a full face piece mask having a sealing edge in contact with the face of the user, said full face piece mask cooperating with said inner half mask to define a space between said inner half mask and said full face piece mask, said space being in communication with the eyes of the user; a flow opening in said full face piece mask for flow into said space; a passage opening connecting said space with an interior of said inner half mask; and indicator means located on a support, said indicator means for indicating an amount of pollutant passing into said interior of said inner half mask, said support being positioned on said inner half mask and having an access surface containing said indicator means, said access surface being in flow contact with air being inhaled and said access surface being positioned (adjoining) said passage opening.

4. A respirator according to claim 3, wherein:
said support is contained in a cup-shaped insert, said insert being connected gas tightly into said passage opening of said inner half mask.

5. A respirator according to claim 3, wherein:
said support is formed as a detachable disk connected to a surface of said inner half mask.

6. A respirator according to claim 3, wherein:
said indicator means is provided with a plurality of indicating ranges and said support is formed as a chip-like support element with said indicating ranges formed thereon, said indicating ranges comprising colorimetric indicator portions exposed to said air being inhaled via openings providing access surfaces of said indicating ranges; optical evaluation means being provided for scanning said indicating ranges to detect changes in said colorimetric indicator.

7. A respirator according to claim 6, wherein:
said indicating ranges on said chip-like support comprise channels with channel openings forming said access surfaces, at least one channel wall being formed as an optically transparent cover.

8. A respirator according to claim 6, wherein:
said indicating ranges are distributed as indication fields in a matrix-like pattern over said chip-like support.

9. A respirator according to claim 8, wherein:
at least one of said indicating ranges is provided uncovered, directly exposed to said air being inhaled.

10. A respirator according to claim 8, wherein:
at least one of said indicating ranges is sealed with an optically transparent cover that is permeable to pollutant potentially in said air being inhaled.

11. A respirator according to claim 6, wherein:
said optical evaluation means includes a light source illuminating said indicator range, a detector receiving transmitted/reflected light from said indicator range and a measuring unit.

12. A respirator according to claim 11, wherein:
said evaluation means is arranged in an immediate vicinity of said support for continuously monitoring said indicator range.

13. A respirator according to claim 6, wherein:
said evaluation means and said support are accommodated in a removable insert, said removable insert including a first insert passage opening and a second insert passage opening, said removable insert receiving said support in a position for exposure to said air being inhaled.

* * * * *